US011752372B2

(12) United States Patent
Damazo et al.

(10) Patent No.: US 11,752,372 B2
(45) Date of Patent: Sep. 12, 2023

(54) IGNITION SUPPRESSING ENCLOSURE HAVING VENT PATHS FOR FLAME QUENCHING

(71) Applicant: The Boeing Company, Chicago, IL (US)

(72) Inventors: Jason S Damazo, Seattle, WA (US); Eddie Kwon, Seattle, WA (US); William J Sweet, Seattle, WA (US); Philipp A Boettcher, Golden, CO (US)

(73) Assignee: The Boeing Company, Chicago, IL (US)

( * ) Notice: Subject to any disclaimer, the term of this patent is extended or adjusted under 35 U.S.C. 154(b) by 504 days.

(21) Appl. No.: 16/825,621

(22) Filed: Mar. 20, 2020

(65) Prior Publication Data

US 2021/0290994 A1 Sep. 23, 2021

(51) Int. Cl.
*A62C 2/06* (2006.01)
*A62C 3/16* (2006.01)

(52) U.S. Cl.
CPC . *A62C 2/06* (2013.01); *A62C 3/16* (2013.01)

(58) Field of Classification Search
CPC ..... B64D 37/32; B64D 2037/325; A62C 2/06–248; A62C 3/16
USPC ..... 169/45, 49
See application file for complete search history.

(56) References Cited

U.S. PATENT DOCUMENTS 10,512,805 B2 12/2019 Damazo et al.
2010/0284150 A1* 11/2010 Manahan ..... F28F 7/00 361/695
2015/0060465 A1* 3/2015 Limbacher ..... H02B 1/28 220/560.01

* cited by examiner

*Primary Examiner* — Christopher R Dandridge
*Assistant Examiner* — Juan C Barrera
(74) *Attorney, Agent, or Firm* — Vivacqua Crane PLLC

(57) ABSTRACT

An ignition suppressing enclosure configured to contain an ignition source is disclosed and includes a body portion defining an inner surface, an outer surface, and an enclosed volume containing a flammable gaseous mixture. The enclosed volume is sized to contain the ignition source. The enclosed volume of the ignition suppressing enclosure is surrounded by an exterior combustible environment also containing the flammable gaseous mixture. The ignition suppressing enclosure includes one or more vent paths that extend between the inner surface and the outer surface of the body portion, where each individual vent path includes an effective diameter based on at least a minimum ignition energy of the flammable gaseous mixture. The effective diameter of the individual vent path is selected to quench a flame that occurs within the enclosed volume of the ignition suppressing enclosure.

20 Claims, 4 Drawing Sheets

IGNITION SUPPRESSING ENCLOSURE HAVING VENT PATHS FOR FLAME QUENCHING

INTRODUCTION

The present disclosure relates to an ignition suppressing enclosure. More particularly, the present disclosure is directed towards an ignition suppressing enclosure having one or more vent paths configured to quench a flame occurring within an enclosed volume of the ignition suppressing enclosure.

BACKGROUND

Explosion-proof equipment is required in a flammable environment. For example, explosion-proof equipment is required in flammability zones around an aircraft when the aircraft's fuel tank is being purged. In one approach, a leak-proof container that hydraulically isolates an interior environment from a flammable exterior combustible environment may be used as an explosion-proof container. Therefore, if the equipment located within the leak-proof container produces an ignition source, the surrounding exterior combustible environment does not ignite. However, this approach the leak-proof requirement lasts for the lifetime of the container. Moreover, the leak-proof container has a relatively small enclosure for containing items. The leak-proof container may also be difficult to test. All of these issues increase the overall cost of the container.

Although alternative approaches exist for providing explosion-proof equipment, these methodologies also have drawbacks. For example, in another approach, redundant electrical connectors are used to ensure that it is highly unlikely, if not almost impossible, that an ignition source would be created even under suspected failure modes. However, providing redundant electrical connectors increases the overall costs of the equipment. Moreover, redundant electrical connectors are rarely relied upon as the sole approach for preventing an ignition source from propagating to a flammable environment.

SUMMARY

According to several aspects, an ignition suppressing enclosure configured to contain an ignition source is disclosed. The ignition suppressing enclosure includes a body portion defining an inner surface, an outer surface, and an enclosed volume containing a flammable gaseous mixture and sized to contain the ignition source. The enclosed volume of the ignition suppressing enclosure is surrounded by an exterior combustible environment also containing the flammable gaseous mixture. The ignition suppressing enclosure also includes one or more vent paths that extend between the inner surface and the outer surface of the body portion, where an individual vent path of the one or more vent paths includes an effective diameter based on at least a minimum ignition energy of the flammable gaseous mixture. The effective diameter of the individual vent path is selected to quench a flame that occurs within the enclosed volume of the ignition suppressing enclosure.

In another aspect, a method for preventing an ignition source from igniting a combustible environment surrounding an ignition suppressing enclosure is disclosed. The method includes igniting a flammable gaseous mixture located inside an enclosed volume of the ignition suppressing enclosure. The enclosed volume contains flammable gaseous mixture and is surrounded by an exterior combustible environment also containing the flammable gaseous mixture. The method also includes allowing the flammable gaseous mixture to pass through one or more vent paths. An individual vent path includes an effective diameter based on at least a minimum ignition energy of the flammable gaseous mixture and the vent paths are configured to quench a flame that occurs within the enclosed volume of the ignition suppressing enclosure. Finally, the method includes allowing the flammable gaseous mixture to exit the vent paths and flow into the combustible environment surrounding the ignition suppressing enclosure.

The features, functions, and advantages that have been discussed may be achieved independently in various embodiments or may be combined in other embodiments further details of which can be seen with reference to the following description and drawings.

BRIEF DESCRIPTION OF THE DRAWINGS

The drawings described herein are for illustration purposes only and are not intended to limit the scope of the present disclosure in any way.

DETAILED DESCRIPTION

The present disclosure is directed towards an ignition suppressing enclosure, where an ignition source is placed within an enclosed volume of the ignition suppressing enclosure. The enclosed volume of the ignition suppressing enclosure as well as the exterior combustible environment surrounding the ignition suppressing enclosure both contain a flammable gaseous mixture. The ignition suppressing enclosure includes one or more vent paths disposed between an inner surface and an outer surface of a wall of the ignition suppressing enclosure. Each individual vent path includes an effective diameter based on at least a minimum ignition energy of the flammable gaseous mixture surrounding the ignition suppressing enclosure. The effective diameter of the individual vent path is selected to quench a flame that occurs within the enclosed volume of the ignition suppressing enclosure. In other words, the disclosed ignition suppressing enclosure includes one or more vent paths that ensure that a self-propagating flame is quenched by heat loss to the ignition suppressing enclosure.

The vent paths are configured to vent pressure that builds up inside the interior volume of the ignition suppressing enclosure. Furthermore, the vent paths are configured to prevent the ignition source from igniting the combustible environment that surrounds the ignition suppressing enclosure. The present disclose also describes a method for preventing the ignition source from igniting the combustible environment 40 surrounding the ignition suppressing enclosure.

The following description is merely exemplary in nature and is not intended to limit the present disclosure, application, or uses.

Figure 1:
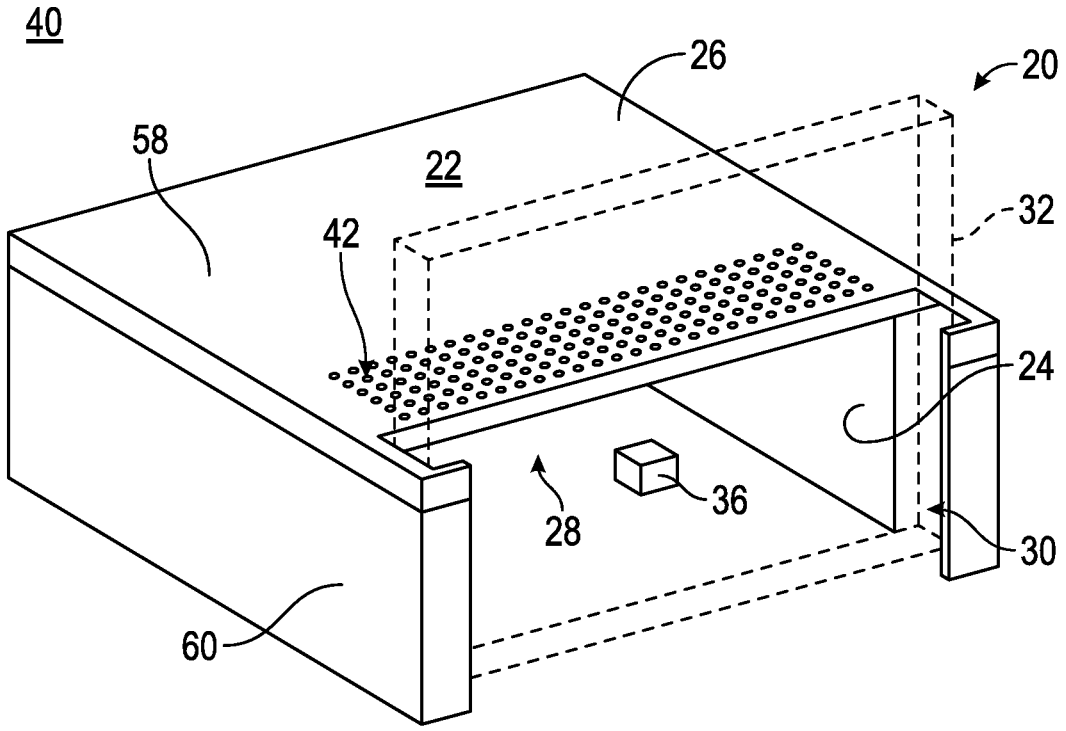
FIG. 1 is a perspective view of the disclosed ignition suppressing enclosure containing an ignition source and having one or more vent paths, according to an exemplary embodiment.

Referring to FIG. 1, a perspective view of an exemplary ignition suppressing enclosure 20 is shown. The ignition suppressing enclosure 20 includes a body portion 22 defining an inner surface 24, an outer surface 26, and an enclosed volume 28. In one non-limiting embodiment, the body portion 22 of the ignition suppressing enclosure 20 includes an open end 30 and a slidable wall 32. The slidable wall 32 is illustrated as a transparent member and is shown in phantom line. The slidable wall 32 is configured to seal off the open end 30 of the body portion 22 of the ignition suppressing enclosure 20 when in a closed position as seen in FIG. 1. The enclosed volume 28 of the ignition suppressing enclosure 20 contains a flammable gaseous mixture. Furthermore, the ignition suppressing enclosure 20 is surrounded by an exterior combustible environment 40 that also contains the flammable gaseous mixture as well. The enclosed volume 28 of the ignition suppressing enclosure 20 is sized to contain an ignition source 36. The ignition suppressing enclosure 20 also includes or more vent paths 42 that extend through the body portion 22 of the ignition suppressing enclosure 20. The one or more vent paths 42 are configured to prevent the ignition source 36, which is confined to the enclosed volume 28 of the ignition suppressing enclosure 20, from igniting the exterior combustible environment 40 that surrounds the ignition suppressing enclosure 20.

The ignition suppressing enclosure 20 is constructed of materials that are compatible with the combustible environment 40. Some examples of material used for the ignition suppressing enclosure include, but are not limited to, a metal such as aluminum, plastics such as nylon, carbon fiber reinforced polymers, and fiberglass. The flammable gaseous mixture includes a minimum ignition energy of at least 15 microjoules. In one non-limiting embodiment, the ignition suppressing enclosure 20 is used in an aerospace application, and the ignition suppressing enclosure 20 is constructed of an electrically insulating material and the flammable gaseous mixture includes a minimum ignition energy that ranges from 190 to 200 millijoules. Some examples of flammable gaseous mixtures that may be used in an aerospace application include a hexane/air mixtures having a fuel-air equivalence ratio of 1.8, 1.15, or 1.0. Although an aerospace application is described, the ignition suppressing enclosure 20 may be used in a variety of other applications such as, for example, the petroleum, chemical, and pharmaceutical industries, which deal with flammable gases and powders.

Figure 2:
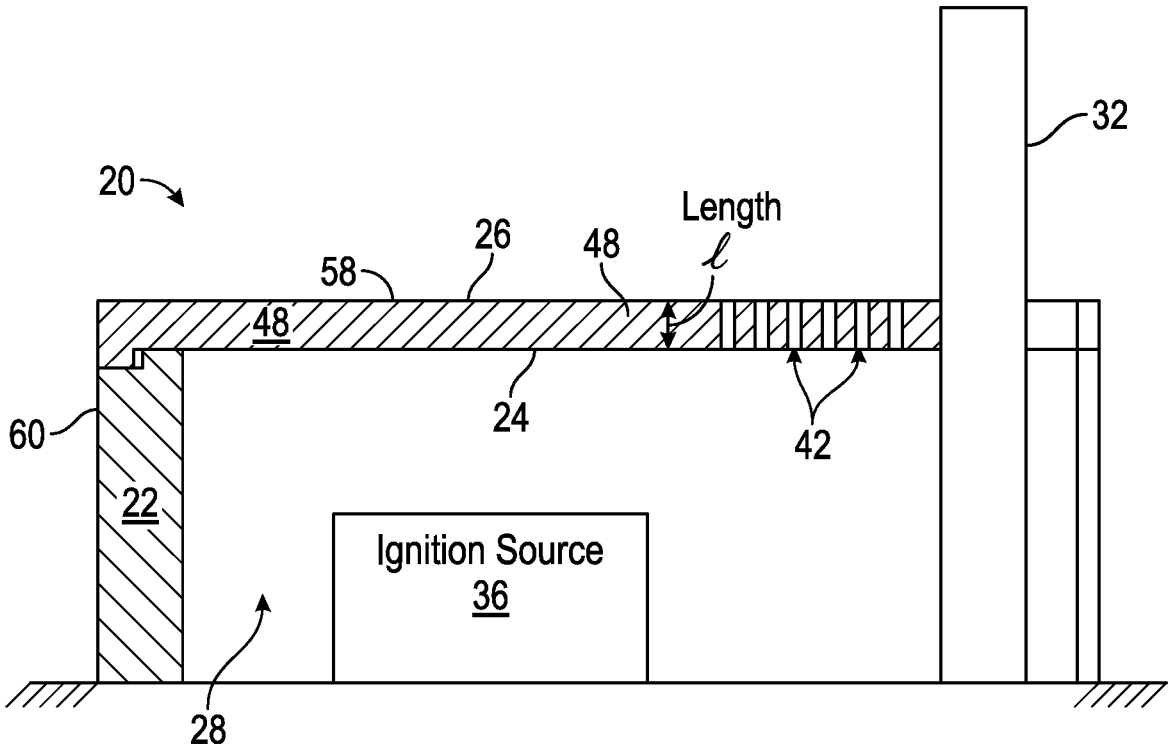
FIG. 2 is a cross-sectioned side view of the ignition suppressing enclosure shown in FIG. 1, according to an exemplary embodiment.

Referring to FIGS. 1 and 2, the ignition source 36 is any object generating sufficient heat energy to cause the flammable gaseous mixture to ignite and burn. Some examples of the ignition source 36 include, but are not limited to, an electrical arc, a hot surface, a hot particle ejection, and an electrostatic discharge due to internal friction or tribocharging. It is to be appreciated that the ignition source 36 would ignite the combustible environment 40 if the ignition suppressing enclosure 20 was omitted.

Figure 5:
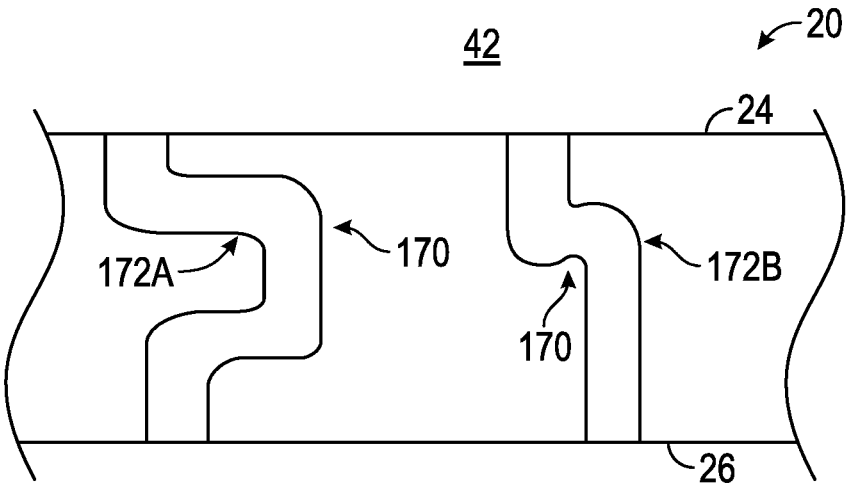
FIG. 5 is a side view of another embodiment of the ignition suppressing enclosure illustrating the vent paths having a bent profile, according to an exemplary embodiment.

The one or more vent paths 42 extend between the inner surface 24 and the outer surface 26 of the body portion 22 of the ignition suppressing enclosure 20. In the embodiment as shown in FIG. 2, the vent paths 42 extend straight through a wall 48 of the ignition suppressing enclosure 20. In other words, the vent paths 42 are positioned perpendicular with respect to the inner surface 24 and the outer surface 26 of the body portion 22 of the ignition suppressing enclosure 20. However, it is to be appreciated that the vent paths 42 are not limited to the embodiment as shown in FIG. 2. In the alternative embodiments as shown in FIG. 5, the vent paths 42 include one or more bends 170 and are non-linear.

Figure 3A:
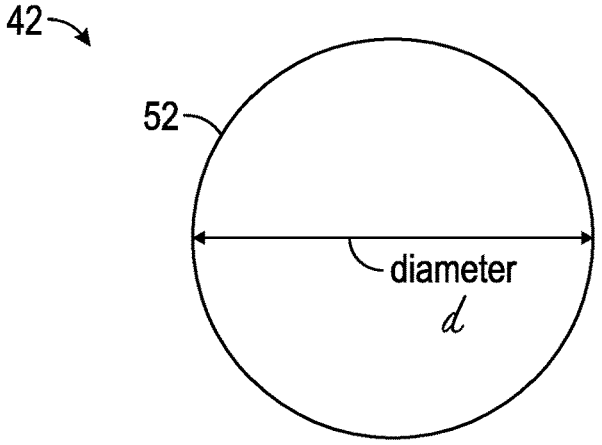
FIG. 3A is a top view of a circular cross-sectional area of an individual vent path, according to an exemplary embodiment.
Figure 3B:
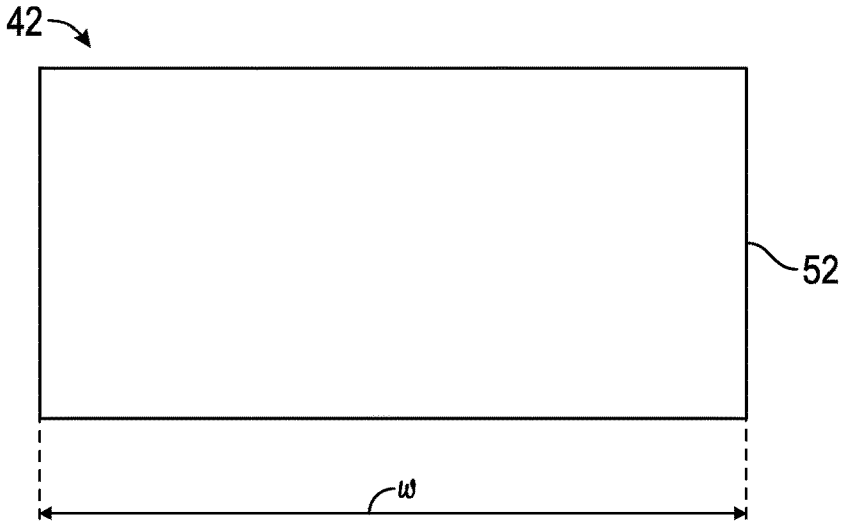
FIG. 3B is a top view of a rectangular cross-sectional area of an individual vent path, according to an exemplary embodiment.
Figure 3C:
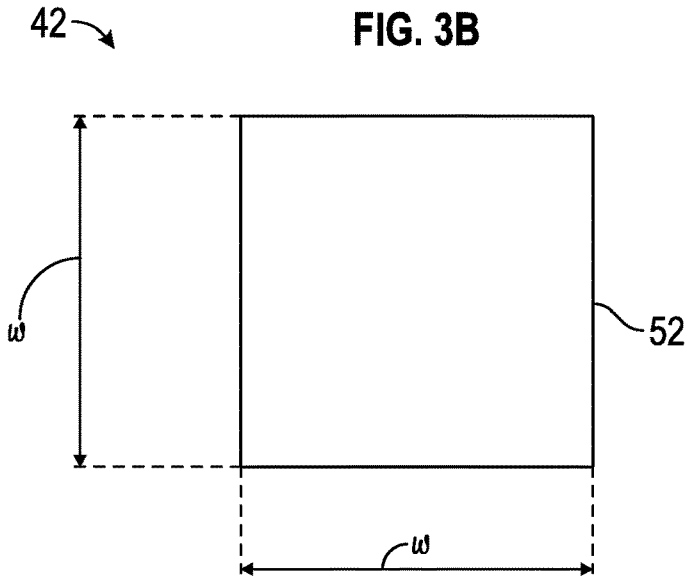
FIG. 3C is a top view of a square cross-sectional area of an individual vent path, according to an exemplary embodiment.

FIGS. 3A, 3B, and 3C illustrate exemplary cross-sectional areas 52 of an individual vent path 42. Referring to FIGS. 2 and 3A, the individual vent path 42 includes an effective diameter based on at least a minimum ignition energy of the flammable gaseous mixture surrounding the ignition suppressing enclosure 20. The effective diameter of the individual vent path 42 is selected to quench a flame that occurs within the enclosed volume 28 of the ignition suppressing enclosure 20. Specifically, the one or more vent paths 42 ensure that a self-propagating flame located within the enclosed volume 28 of the ignition suppressing container 20 is quenched by heat loss before the flammable gaseous mixture flows to the exterior combustible environment. The flammable gaseous mixture is cooled while flowing through the vent paths 42 to a temperature that ensures that the flammable gaseous mixture does not ignite when reaching the exterior combustible environment.

In the embodiment as shown in FIGS. 3A-3C, the individual vent path 42 includes a definite, pre-defined shape, and the effective diameter of the individual vent path 42 is a hydraulic diameter $D_H$ of the individual vent path 42. The hydraulic diameter $D_H$ of the individual vent path 42 is less than a critical quenching diameter of the individual vent path 42. The critical quenching diameter of the individual vent path 42 is directly proportional to a minimum ignition energy of the flammable gaseous mixture contained within the enclosed volume 28 of the ignition suppressing enclosure 20. For example, if the minimum ignition energy of the flammable gaseous mixture decreases, then it follows that critical quenching diameter of the vent path also decreases. Furthermore, the critical quenching diameter is empirically determined based on a specific type of ignition source (e.g., electrical arc, a hot surface, etc.) and the chemical composition of the flammable gaseous mixture. The hydraulic diameter $D_H$ is also based on a maximum experimental safe gap, which classifies the flammable gaseous mixture contained within the enclosed volume 28 of the ignition suppression enclosure 20. The maximum experimental safe gap is a standardized measurement relating to a maximum gap size through which a flame generated in a standardized volume could not escape.

In one embodiment, if the ignition suppressing enclosure 20 is employed in an aerospace application, then the flammable gaseous mixture includes a minimum ignition energy that ranges from 190 to 200 millijoules, and the critical quenching diameter of the individual vent path 42 is about one millimeter, where the term about includes dimensions that are up to thirty percent more or less than one millimeter. If the critical quenching diameter of the individual vent path 42 is about one millimeter, then a length L of the individual vent path is expressed in Equation 1 as:

$$L > 200SD_H^2 \quad \text{Equation 1}$$

where L represents the length, S represents a flame speed, and $D_H$ represents the hydraulic diameter. The flame speed S is dependent upon the specific flammable gases mixture and the geometry of the individual vent path 42.

The hydraulic diameter $D_H$ is expressed in Equation 2 as:

$$D_H = \frac{4A}{P} \quad \text{Equation 2}$$

where A represents the cross-sectional area 52 of the vent path 42, and P represents a wetted perimeter of the vent channel. As seen in FIGS. 3A-3C, the cross-sectioned area 52 of the individual vent path 42 includes either a round profile, a rectangular profile, or a square profile, however it is to be appreciated that other cross-sectional areas may be used as well. In the embodiment as shown in FIG. 3A, the individual vent path 42 includes a circular cross-sectional area 52. Thus, a diameter of the circular cross-sectional area 52 is represented by d. If the area A in Equation 2 is represented as $\pi d^2/4$ and the wetted perimeter P is represented as Rd, then Equation 2 is equal to the diameter d. In the embodiment as shown in FIG. 3B, the individual vent path 42 includes a slotted or rectangular cross-sectional area 52 having a width w and a length l (seen in FIG. 2), where the length l is far greater than the width (where l>>w). If the area A in Equation 2 is represented as (l·w), and the wetted perimeter P is represented as 21, then Equation 2 is equal to twice the width, or 2 w. In the embodiment as shown in FIG. 3C, the individual vent path 42 includes a square cross-sectional area 52. If both sides of the square cross-sectional area 52 are represented as the width w, and if the length l of the individual vent path 42 is far greater than the width w, then Equation 2 yields a hydraulic diameter $D_H$ of w. Although FIGS. 3A-3C illustrate a circle, a rectangle, and a square, is to be appreciated that the vent path 42 include any number of cross-sectional areas 52.

The specific cross-sectional area 52 of the individual vent path 42 is determined, in the most part, based on ease of manufacturing. For example, if the vent paths 42 are created by a subtractive manufacturing process such as, for example, drilling, then a circular shape would be selected as the cross-sectional area 52. However, if the vent paths 42 are created by a sintering process, then the cross-sectional area 52 would include a stochastic profile, such as the shape shown in FIG. 4B. It is to be appreciated that the specific shape of the cross-sectional area 52 of the vent paths 42 do influence venting and quenching of the ignition source 36 (FIG. 2), however, the cross-sectional area 52 is select based on manufacturing considerations.

Referring to FIGS. 2 and 3A-3C, is to be appreciated that the hydraulic diameter $D_H$ and the length L of the vent paths 42 are selected to quench a flame created by the ignition source 36. However, a total number of vent paths 42 included in the ignition suppressing enclosure 20 are selected to vent pressure that accumulates within the enclosed volume 28 of the ignition suppressing enclosure 20. However, in some instances, the total number of vent paths 42 are decreased instead to lower the pressure within the enclosed volume 28 of the ignition suppressing enclosure 20, which in turn also provides flame quenching.

Continuing to refer to FIGS. 1 and 2, in the non-limiting embodiment as shown, the vent paths 42 are disposed along an upper surface 58 of the ignition suppressing enclosure 20. However, it is to be appreciated that the vent paths 42 are not limited in placement to the upper surface 58. If the location of the ignition source 36 within the enclosed volume 28 is known, then the vent paths 42 may be placed further away from the ignition source 36. For example, in another embodiment, the vent paths 42 may be placed along one or more of the side surfaces 60 of the ignition suppressing enclosure 20.

Figure 4A:
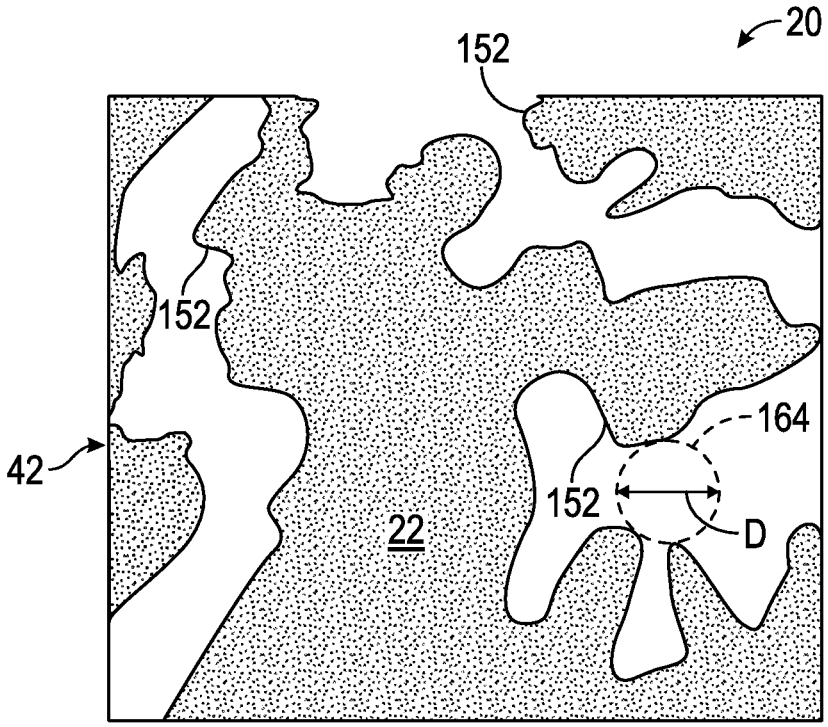
FIG. 4A is a top view of another embodiment of the ignition suppressing enclosure illustrating the vent paths having a stochastic profile, according to an exemplary embodiment.
Figure 4B:
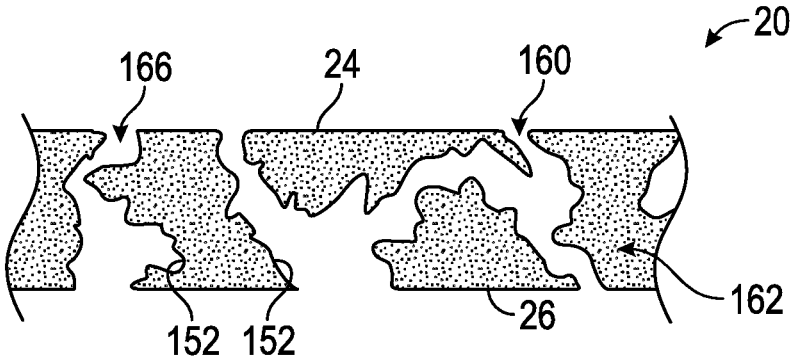
FIG. 4B is a side view of the ignition suppressing enclosure illustrating the vent paths shown in FIG. 4A, according to an exemplary embodiment.

FIG. 4A is an alternative embodiment of the individual vent paths 42 shown in FIGS. 3A-3C, where the vent paths 42 are not definite, pre-defined shapes. Instead, the vent paths 42 form non-uniform or stochastic cross-sectional openings 152. Referring to FIG. 4B, the body portion 22 of the ignition suppressing enclosure 20 has a mesh structure including a plurality of randomly dispersed pores 160 that are supported by a plurality of struts 162. The struts 162 may also be referred to as trusses or ligaments. In the example as shown in FIGS. 4A and 4B, the effective diameter of the individual vent path 42 is defined by a maximum pore size of the individual vent path 42. The maximum pore size of the individual vent path 42 is represented by sphere 164, where a sphere having a diameter D equal to the maximum pore size is configured to pass through the individual vent paths 42. It is to be appreciated that although the vent paths 42 shown in FIG. 4A include a stochastic cross-sectional opening 152, the individual vent paths 42 also include a respective hydraulic diameter $D_H$ and a critical quenching diameter.

FIG. 4B is a side view the wall 48 of the ignition suppressing enclosure 20, illustrating the vent paths 42. Unlike the vent paths 42 shown in FIG. 2, the vent paths 42 are stochastic or random, and include passages 166 that extend in a non-linear or circuitous direction between the inner surface 24 and the outer surface 26 of the body portion 22 of the wall 48. Furthermore, in the embodiment as shown in FIG. 48, at least some of the individual vent paths 42 are fluidly interconnected with one another.

FIG. 5 illustrates yet another embodiment of the vent paths 42 of the ignition suppressing enclosure 20, where the vent paths 42 are also non-linear. Specifically, the individual vent paths 42, which extend between the inner surface 24 and the outer surface 26 of the body portion 22, include one or more bends 170. For example, in an embodiment, the vent paths 42 include one or more elbows 172A, 172B. Specifically, the elbow 172A is angled at ninety degrees, and the elbow 172B is angled at either forty-five degrees.

Figure 6:
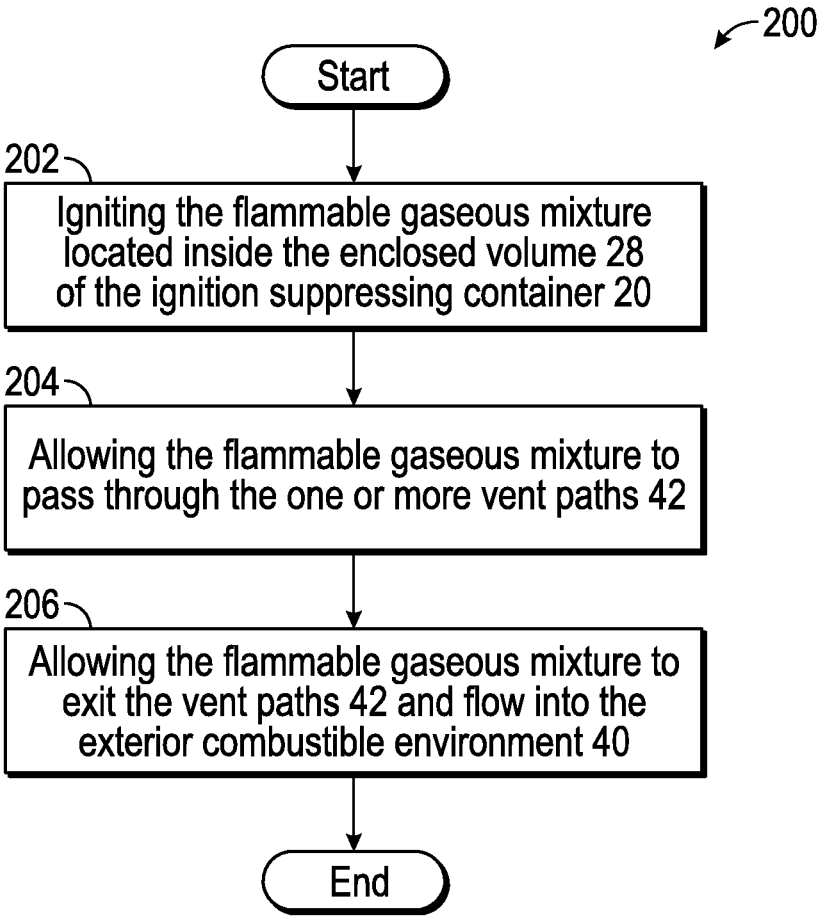
FIG. 6 is a method for preventing the ignition source from igniting a combustible environment surrounding the ignition suppressing enclosure, according to an exemplary embodiment.

FIG. 6 is an exemplary process flow diagram illustrating a method 200 for preventing the ignition source 36 from igniting the combustible environment 40 surrounding the ignition suppressing enclosure 20. Referring generally to FIGS. 1-6, the method 200 begins at block 202. In block 202, the flammable gaseous mixture located inside the enclosed volume 28 of the ignition suppressing enclosure 20 is ignited. As mentioned above, the enclosed volume 28 contains flammable gaseous mixture and is surrounded by the exterior combustible environment 40, which also contains the flammable gaseous mixture. The method 200 may then proceed to block 204.

In block 204, the flammable gaseous mixture is allowed to pass through the one or more vent paths 42, where the vent paths 42 include an effective diameter based on at least the minimum ignition energy of the flammable gaseous mixture. The vent paths 42 are configured to quench a flame that occurs within the enclosed volume 28 of the ignition suppressing enclosure 20. Specifically, the flammable gaseous mixture is cooled while flowing through the vent paths 42 to a temperature that ensures that the flammable gaseous mixture will not ignite when reaching the exterior combustible environment. The method 200 may then proceed to block 206.

In block 206, the flammable gaseous mixture is allowed to exit the vent paths 42 and flow into the combustible environment 40 surrounding the ignition suppressing enclosure 20. The method may then terminate.

Referring generally to the figures, the disclosed ignition suppressing enclosure provide various technical effects and benefits. Specifically, the disclosed ignition suppressing enclosure includes one or more vent paths that ensure a self-propagating flame is quenched by heat loss before the flammable gaseous mixture flows to the exterior environment, which is combustible. The disclosed ignition suppressing container provides the same function as some conventional enclosures, however, the disclosed ignition suppressing container is not leak-proof, which in turn reduces expenses in design, manufacturing, and inspection. Furthermore, the disclosed ignition suppressing container is also far easier to test and verify when compared to the conventional enclosures, which also reduces cost as well.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An ignition suppressing enclosure configured to contain an ignition source, the ignition suppressing enclosure comprising:

a body portion defining an inner surface, an outer surface, and an enclosed volume containing a flammable gaseous mixture and sized to contain the ignition source, wherein the ignition suppressing enclosure is surrounded by an exterior combustible environment also containing the flammable gaseous mixture; and one or more vent paths that extend between the inner surface and the outer surface of the body portion, wherein an individual vent path of the one or more vent paths includes an effective diameter based on at least a minimum ignition energy of the flammable gaseous mixture, and wherein the effective diameter of the individual vent path is selected to quench a flame that occurs within the enclosed volume of the ignition suppressing enclosure, wherein the effective diameter is a hydraulic diameter of the individual vent path, the individual vent path includes a critical quenching diameter of one millimeter, and a length of the individual vent path is expressed as:

$$L>200SD_H^2$$

wherein L represents the length, S represents a flame speed, and $D_H$ represents the hydraulic diameter.

2. The ignition suppressing enclosure of claim 1, wherein the hydraulic diameter of the individual vent path is less than the critical quenching diameter of the individual vent path.

3. The ignition suppressing enclosure of claim 2, wherein the critical quenching diameter of the individual vent path is directly proportional to a minimum ignition energy of the flammable gaseous mixture.

4. The ignition suppressing enclosure of claim 1, wherein a cross-sectioned area of the individual vent path includes a round profile, a rectangular profile, or a square profile.

5. The ignition suppressing enclosure of claim 1, wherein the effective diameter is a maximum pore size of the individual vent path.

6. The ignition suppressing enclosure of claim 5, wherein a sphere having a diameter equal to the maximum pore size is configured to pass through the individual vent path.

7. The ignition suppressing enclosure of claim 5, wherein the body portion of the ignition suppressing enclosure has a mesh structure including a plurality of randomly dispersed pores that are supported by a plurality of struts.

8. The ignition suppressing enclosure of claim 5, wherein the one or more vent paths include passages extending in a circuitous direction between the inner surface and the outer surface of the body portion of the ignition suppressing enclosure.

9. The ignition suppressing enclosure of claim 8, wherein the one or more vent paths are fluidly interconnected with one another.

10. The ignition suppressing enclosure of claim 1, wherein the one or more vent paths are positioned perpendicular with respect to the inner surface and the outer surface of the body portion of the ignition suppressing enclosure.

11. The ignition suppressing enclosure of claim 1, wherein the one or more vent paths include one or more bends.

12. The ignition suppressing enclosure of claim 1, wherein the flammable gaseous mixture includes a minimum ignition energy of at least 15 microjoules.

13. The ignition suppressing enclosure of claim 1, wherein the ignition suppressing enclosure is constructed of one or more of the following: metal, nylon, carbon fiber reinforced polymers, and fiberglass.

14. The ignition suppressing enclosure of claim 1, wherein the individual vent path includes a definite, predefined shape.

15. The ignition suppressing enclosure of claim 1, wherein the critical quenching diameter of the individual vent path includes dimensions that are up to thirty percent more or less than one millimeter.

16. The ignition suppressing enclosure of claim 1, wherein the flammable gaseous mixtures has a fuel-air equivalence ratio of one of the following: 1.8, 1.15, and 1.0.

17. A method for preventing an ignition source from igniting a combustible environment surrounding an ignition suppressing enclosure, the method comprising:

igniting a flammable gaseous mixture located inside an enclosed volume of the ignition suppressing enclosure, wherein the enclosed volume contains flammable gaseous mixture and is surrounded by an exterior combustible environment also containing the flammable gaseous mixture, wherein the ignition suppression enclosure comprises a body portion defining an inner surface, an outer surface, and the enclosed volume;

allowing the flammable gaseous mixture to pass through one or more vent paths, wherein the one or more paths extend between the inner surface and the outer surface of the body portion, wherein an individual vent path includes an effective diameter based on at least a minimum ignition energy of the flammable gaseous mixture and are configured to quench a flame that occurs within the enclosed volume of the ignition suppressing enclosure, wherein the effective diameter is a hydraulic diameter of the individual vent path, the individual vent path includes a critical quenching diameter of one millimeter, and a length of the individual vent path is expressed as:

$$L>200SD_H^2$$

wherein L represents the length, S represents a flame speed, and $D_H$ represents the hydraulic diameter; and allowing the flammable gaseous mixture to exit the vent paths and flow into the combustible environment surrounding the ignition suppressing enclosure.

18. The method of claim 17, wherein the hydraulic diameter of the individual vent path is less than the critical quenching diameter of the individual vent path.

19. The method of claim 17, wherein the effective diameter is a maximum pore size of the individual vent path.

20. The method of claim 19, wherein a sphere having a diameter equal to the maximum pore size is configured to pass through the individual vent path.

* * * * *